US005782556A

United States Patent [19]

Chu

[11] Patent Number: 5,782,556

[45] Date of Patent: Jul. 21, 1998

[54] APPARATUS FOR QUICKLY MAKING MULTIPLE-PHASE MICROEMULSION FUEL OIL

[76] Inventor: Chai-Kan Chu, P.O. Box 55-846, Taipei, Taiwan

[21] Appl. No.: 923,636

[22] Filed: Sep. 4, 1997

[51] Int. Cl.[6] ..... B01F 5/10; B01F 15/02

[52] U.S. Cl. ..... 366/155.1; 366/171.1; 366/172.1; 366/174.1; 366/181.4; 366/192; 366/265; 366/307

[58] Field of Search ..... 366/134, 154.1, 366/155.1, 158.5, 160.1, 160.2, 162.1, 167.1, 168.1, 171.1, 172.1, 174.1, 181.4, 192, 262, 263, 265, 290, 291, 292, 306, 307

[56] References Cited

U.S. PATENT DOCUMENTS

| | | | |
|---|---|---|---|
| 1,765,386 | 6/1930 | Wait | 366/265 |
| 2,139,430 | 12/1938 | Witham, Jr. | 366/262 |
| 2,316,769 | 4/1943 | Chilson | 366/290 |
| 2,387,488 | 10/1945 | Acken et al. | 366/181.4 X |
| 3,189,080 | 6/1965 | Overcashier et al. | 366/181.4 X |
| 4,293,230 | 10/1981 | Tan et al. | 366/101 |
| 4,483,624 | 11/1984 | Bacon, Jr. et al. | 366/263 X |
| 4,955,723 | 9/1990 | Schneider | 366/290 X |
| 5,240,327 | 8/1993 | Nyman et al. | 366/262 X |

*Primary Examiner*—Charles E. Cooley

[57] ABSTRACT

An apparatus for quickly making multiple-phase microemulsion fuel including: a primary mixer for primarily mixing water, catalyst, emulsifying agent, stabilizer and little quantity of oil in the primary mixer for producing oil-in-water phase mixing liquid; and a secondary mixer having a turbine agitator rotatably mounted in the secondary mixer, an eddy-flow guiding device of calabash shape disposed around the turbine agitator for producing upwardly and downwardly curved eddy flows of a mixing solution in the secondary mixer fed with the mixing liquid supplied from the primary mixer and raw fuel oil, and a plurality of turbulence baffles radially secured in the secondary mixer for limiting the eddy flows of the mixing solution in the secondary mixer into a plurality of eddy-flow "sector zones" for accelerating a thorough mixing and emulsion of the fuel oil with the oil-in-water phase mixing liquid for quickly producing water-in-oil phase fuel oil for better combustion efficiency and less air pollution when burnt.

4 Claims, 2 Drawing Sheets

$O_2$
$O_1$+B
C
A
W
262
260
261
26
25
222
221
211
251
21
24
2
27
R
E
E'
231
22
241
23
232
28
29
281
230
151
15
1
11
12
121
122
13
14
240

APPARATUS FOR QUICKLY MAKING MULTIPLE-PHASE MICROEMULSION FUEL OIL

BACKGROUND OF THE INVENTION

U.S. Pat. No. 4,293,230 to Tan et al. discloses an apparatus for providing fuel for an oil burner including turbulence created by fluid flow and turbulence created by mechanical agitation by using compressed air for creating the turbulence.

However, the water and the fuel is premixed in the premixing chamber (161) and then further mixed with the compressed air in the air atomizing chamber (151). The mixed fuel is then further agitated and mixed by the impellers (157,158) in the mechanical agitation chambers in order to be sent to the burner for combustion. So, this apparatus only provides fuel ready for combustion in the burner, not for storage or shipping purpose. It requires gigantic systematic equipments such as the delivery system for supplying water, fuel and compressed air respectively, not suitable for an end user of small consumption of fuel oil and thereby limiting its commercial uses.

SUMMARY OF THE INVENTION

The object of the present invention is to provide an apparatus for quickly making multiple-phase microemulsion fuel including: a primary mixer for primarily mixing water, catalyst, emulsifying agent, stabilizer and little quantity of oil in the primary mixer for producing oil-in-water phase mixing liquid; and a secondary mixer having a turbine agitator rotatably mounted in the secondary mixer, an eddy-flow guiding device of calabash shape disposed around the turbine agitator for producing upwardly and downwardly curved eddy flows of a mixing solution in the secondary mixer fed with the mixing liquid supplied from the primary mixer and raw fuel oil, and a plurality of turbulence baffles radially secured in the secondary mixer for limiting the eddy flows of the mixing solution in the secondary mixer into a plurality of eddy-flow "sector zones" for accelerating a thorough mixing and emulsion of the fuel oil with the oil-in-water phase mixing liquid for quickly producing (converting) water-in-oil phase fuel oil for better combustion efficiency and less air pollution when burnt in a conventional burner.

DETAILED DESCRIPTION

Figures 1, 2:
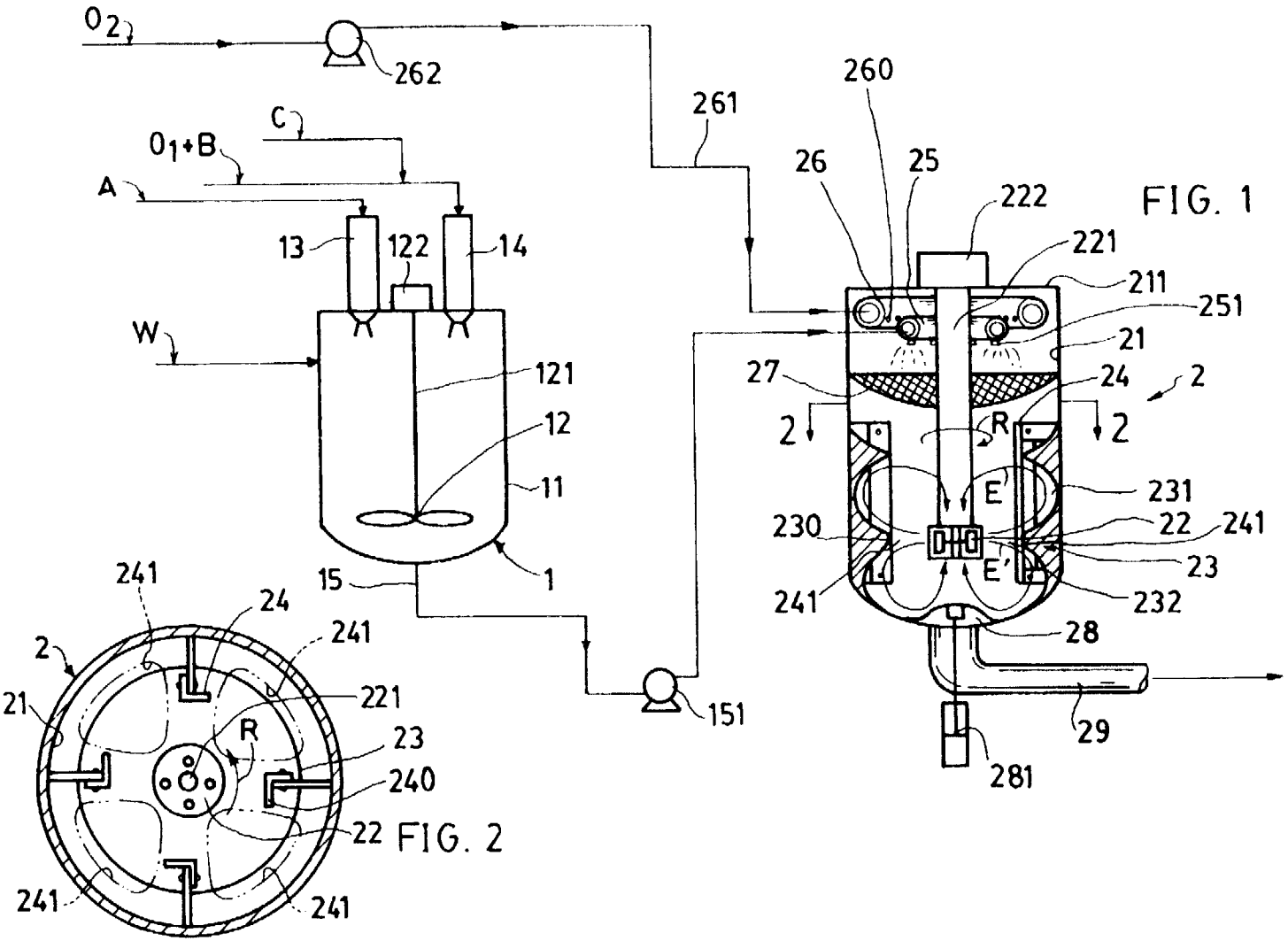
FIG. 1 shows a systematic equipment of the present invention.
FIG. 2 is a cross sectional drawing of the secondary mixer as viewed from 2—2 direction of FIG. 1.
Figure 3:
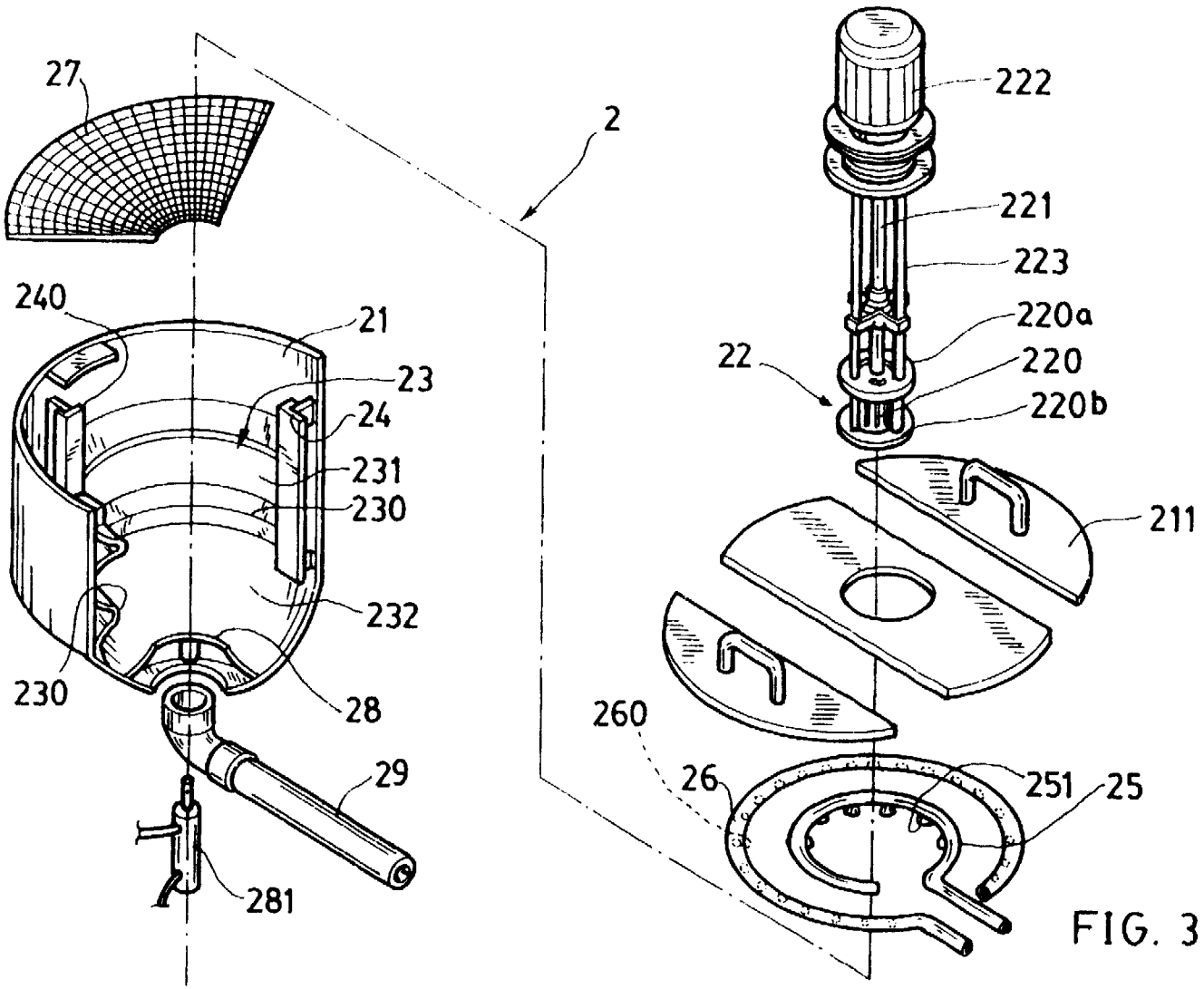
FIG. 3 is an exploded view of the secondary mixer of the present invention.

As shown in FIGS. 1–3, the present invention comprises: a primary mixer 1 and a secondary mixer 2.

The primary mixer 1 includes: a primary tank 11, an agitator 12 having a driving shaft 121 driven by a driving motor 122 mounted on the tank 11, a first quantitative charger 13 mounted on the primary tank 11 for quantitatively feeding the catalyst A into the tank 11 through the quantitative charger 13 for premixing the soft water W fed into the tank 11 and the catalyst A, and a second quantitative charger 14 mounted on the tank 11 for quantitatively feeding the emulsifying agent B, a little quantity of fuel oil $O_1$ and the stabilizer C into the tank 11 for homogeneously mixing the water W with the oil $O_1$, the catalyst A, the emulsifying agent B and the stabilizer C for producing oil-in-water phase ($O_1$/W) mixing liquid as discharged from a delivery pipe 15 under the tank 11.

The proportion of the raw materials as fed into the primary mixer 1 will vary dependent upon the specification or properties of the fuel (heavy) oils and the specific requirements of the end users.

Generally, their mixing proportion by volume are shown as follows:

$$A:W:(O_1+B+C)=(1-3):(100-200):(1-1.5)$$

The secondary mixer 2 includes: a secondary tank 21 having a top cover 211; a turbine agitator 22 provided in a lower portion of the secondary tank 21 and having an agitator shaft 221 driven by a driving motor 222 secured on the top cover 211 or on a top portion of the tank 21; an eddy-flow guiding means 23 having a longitudinal section of calabash shape disposed around the turbine agitator 22 having an upper gourd portion 231 concave radially from a central convex portion 230 towards an inside wall of the secondary tank 21 for upwardly curving an eddy flow E of a mixing solution in the secondary tank 21 as propelled by the turbine agitator 22, the central convex portion 230 convex radially towards the agitator shaft 221 of the turbine agitator 22 to be generally transversely tangential to the turbine agitator 22, and a lower gourd portion 232 concave radially from the central convex portion 230 towards the inside wall of the secondary tank 21 for downwardly curving an eddy flow E' of the mixing solution in the secondary tank 21 as shown in FIG. 1 as propelled by the turbine agitator 22; a bottom valve 28 of mushroom shape forming an arcuate surface convex upwardly towards the agitator shaft 221 to help guide the eddy flow E' upwardly as guided from the lower gourd portion 232 to be sucked by the turbine agitator 22, with the bottom valve 28 normally closing a discharge pipe 29 connected to a bottom of the secondary tank 21; a plurality of turbulence baffles 24 radially mounted in the secondary tank 21 each baffle 24 having a right-angle plate 240 formed as L shape from a cross sectional view of the right-angle plate 240 and orienting in a direction opposite to a rotating direction (R) of the turbine agitator 22 for limiting and "catching") the eddy flow E, E' between two neighboring baffles 24 for forming a "sector zone" (241) of eddy flow between the two neighboring baffles 24 as shown in FIGS. 2, 1; an inner annular sprayer 25 fluidically communicated with the primary mixer 1 by a delivery pipe 15 having a charging pump 151 for feeding the oil-in-water phase mixing liquid from the primary mixer 1 towards the inner annular sprayer 25 to be sprayed downwardly into the secondary tank 21; an outer annular sprayer 26 disposed around the inner annular sprayer 25 and fluidically communicated with an oil feeder pipe 261 having a charging pump 262 for feeding raw heavy oil, fuel oil or crude oil $O_2$ into the outer annular sprayer 26 to be sprayed downwardly into the secondary tank 21; and a conical filter 27 which may be a perforated film plate converging downwardly and formed with fine meshes in the filter 27 for diffusing and homogeneously mixing the oil and mixing liquid as sprayed from the outer and inner annular sprayers 26, 25 for draining into a lower portion of the secondary tank 21 having the turbine agitator 22 provided therein.

The bottom valve 28 is driven by an air cylinder 281 (or other driving means) for opening or closing the valve 28. The fuel product as drained from the pipe 29 may be collected in a storage tank or be filled into drums or containers.

The outer annular sprayer 26 is formed with an annular pipe having a plurality of spray holes or perforations 260 drilled in the annular pipe for spraying oil downwardly.

The inner annular sprayer 25 is formed with an inner annular pipe having a plurality of spray nozzles 251 formed in the inner annular pipe for downwardly spraying the mixing liquid as delivered from the primary mixer 1.

The turbine agitator 22 as shown in FIG. 3 includes: a cylindrical grating 220 disposed about a turbine impeller of the turbine agitator 22 within the grating 220 for splitting and homogeneously agitating the mixing solution, an upper disk 220*a* and a lower disk 220*b* secured on an upper and a lower portion of the grating 220, and a plurality of stems 223 circumferentially fixed in the upper and lower disks 220*a*, 220*b* for protecting the agitator shaft 221 and the turbine agitator 22.

The proportion of the oil-in-water phase mixing liquid from the primary mixer 1 to the heavy oil (or crude oil, or fuel oil) as pumped by the feeder pipe 261 is 1:(3–10) by volume.

The heavy oil and the oil-in-water phase mixing liquid as sprayed from the two annular pipes 26, 25 will be diffused and homogeneously mixed by the conical filter (perforated film plate) 27 and then thoroughly mixed and emulsified by the turbine agitator 22, as guided by the calabash-shaped guiding means 23 and limited by the plural turbulence baffles 24 for forming turbulent and eddy flows in the section zones (or chambers), thereby completely mixing and emulsifying the mixing solution in the secondary tank 21 for producing water-in-oil phase fuel oil product as discharged from the discharge pipe 29.

The volumetric percentage of the "ingredients" for making the fuel oil of the present invention is analysed as: heavy-oil, 95–65%; water (soft water) 5–35%; and catalyst system (including catalyst, emulsifying agent and stabilizer) 0.1–0.4%.

The present invention is superior to the conventional equipments for making the water-containing fuel oil with the following advantages:

1. Due to a thorough mixing and emulsifying to be multiple-phase microemulsion fuel such as oil-in-water phase ($O_1$/W) mixing liquid from primary mixer 1 and then water-in-oil phase fuel ($O_1$/W/$O_2$) having the water dispersed in the oil phase, the mixed and emulsified fuel oil will not be easily segregated into water and oil, durable for storage and convenient for shipping, and also being beneficial for combustion without being separated even at high temperature at burner of 110 to 120 degrees centigrade and high (pumping) pressure of 20 to 30 kilograms per square centimeter.
2. By the special geometric configuration in the secondary mixer 2, e.g., the calabash-shaped eddy-flow guiding means 23 and the mushroom-shaped bottom valve 28 as well as the right-angle turbulence baffles 24, a thorough mixing and emulsion will be effected by this invention with economic equipment and process, omitting the expensive atomizing compressed air system.
3. The diffusion, mixing and emulsion can be subsequently processed by a gravitational descending from the top annular pipes (25,26), the middle filter (27), and the lower turbine agitator (22) for an efficient, space-saving, integrated process especially in the secondary mixer 2, thereby economizing the production facilities and investment cost for producing water-containing fuel oil.

The present invention may be modified without departing from the spirit and scope of this invention. Since the water, the fuel, and the catalyst system are thoroughly mixed, the product fuel oil may thus be designated as a "fusion oil", indicating miscible fuel and water phases without segregation. The baffles 24 as shown in the drawings are four sets, but not limited for the numbers, shapes, and structures of the baffles 24.

I claim:

1. An apparatus for making water-containing fuel oil comprising:

a primary mixer (1) for primarily mixing water with a catalyst, a little quantity of fuel oil including heavy oil and crude oil, emulsifying agent and stabilizer for producing oil-in-water phase mixing liquid; and a secondary mixer (2) fed therein with the oil-in-water phase mixing liquid from the primary mixer (11) and a fuel oil having larger volume than the mixing liquid, said secondary mixer (2) including a turbine agitator (22) rotatably mounted in a lower portion of said secondary mixer (2), an eddy-flow guiding means (23) having a longitudinal section of calabash shape and disposed around said turbine agitator (22) for producing upwardly and downwardly curved eddy flows of a mixing solution consisting of the fuel oil and the mixing liquid from said primary mixer (1), and a plurality of turbulence baffles (24) radially disposed around the turbine agitator (22) for limiting the eddy flows in a plurality of sector zones (241) as defined among said plurality of turbulence baffles (24) for thoroughly mixing and emulsifying the mixing solution to produce microemulsion water-in-oil phase fuel oil;

said secondary mixer (2) including: a secondary tank (21); the turbine agitator (22) provided in a lower portion of the secondary tank (21) and having an agitator shaft (221) driven by a driving motor (222) secured on a top portion of the tank (21); the eddy-flow guiding means (23) disposed around the turbine agitator (22) having an upper gourd portion (231) concave radially from a central convex portion (230) towards an inside wall of the secondary tank (21) for upwardly curving an eddy flow (E) of said mixing solution in the secondary tank (21) as propelled by the turbine agitator (22), the central convex portion (230) convex radially towards the agitator shaft (221) of the turbine agitator (22) to be generally transversely tangential to the turbine agitator (22), and a lower gourd portion (232) concave radially from the central convex portion (230) towards the inside wall of the secondary tank (21) for downwardly curving an eddy flow (E') of the mixing solution in the secondary tank (21) as propelled by the turbine agitator (22); a bottom valve (28) of mushroom shape forming an arcuate surface convex upwardly towards a bottom of the agitator shaft (221) to help guide the eddy flow (E') upwardly as guided from the lower gourd portion (232) to be drafted by the turbine agitator (22), with the bottom valve (28) normally closing a discharge pipe (29) connected to a bottom of the secondary tank (21); said plurality of turbulence baffles (24) radially mounted in the secondary tank (21), each said baffle (24) having a right-angle plate (240) formed as L shape from a cross sectional view of the right-angle plate (240) and orienting in a direction opposite to a rotating direction of the turbine agitator (22) for limiting the eddy flows (E,E') between two neighboring baffles (24) for forming each said sector zone (241) of eddy flow between the two neighboring baffles (24); an inner annular sprayer (25) fluidically communicated with the primary mixer (1) for feeding the oil-in-water phase mixing liquid from the primary mixer (1) towards the inner annular sprayer (25) to be sprayed downwardly into the secondary tank (21); an outer annular sprayer (26) disposed around the inner annular sprayer (25) and fluidically communicated with an oil feeder pipe for feeding raw heavy oil into the outer annular sprayer (26) to be sprayed downwardly into the secondary tank (21); and a conical perforated film plate (27) converging downwardly and formed with fine meshes in the film plate (27) for diffusing and homogeneously mixing the heavy oil and mixing liquid as sprayed from the outer and inner annular sprayers (26,25) and drained into a lower portion of the secondary tank (21) having the turbine agitator (22) provided therein.

2. An apparatus according to claim 1, wherein said outer annular sprayer (26) is formed with an annular pipe having a plurality of spray holes (260) drilled in the annular pipe for spraying heavy oil downwardly into the lower portion of the secondary tank (21).

3. An apparatus according to claim 1, wherein said inner annular sprayer (25) is formed with an inner annular pipe having a plurality of spray nozzles (251) formed in the inner annular pipe for downwardly spraying the mixing liquid as delivered from the primary mixer (1).

4. An apparatus according to claim 1, wherein said turbine agitator (22) includes: a cylindrical grating (220) disposed about a turbine impeller of the turbine agitator (22) within the grating (220), an upper disk (220*a*) and a lower disk (220*b*) secured on an upper and a lower portion of the grating (220), and a plurality of stems (223) circumferentially fixed in the upper and lower disks (220*a*,220*b*) for protecting the agitator shaft (221) and the turbine agitator (22).

* * * * *